US008840424B2

(12) United States Patent
Kudo

(10) Patent No.: US 8,840,424 B2
(45) Date of Patent: Sep. 23, 2014

(54) SHIELD CONNECTOR

(75) Inventor: Takamichi Kudo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 87 days.

(21) Appl. No.: 13/523,936

(22) Filed: Jun. 15, 2012

(65) Prior Publication Data

US 2012/0322307 A1 Dec. 20, 2012

(30) Foreign Application Priority Data

Jun. 17, 2011 (JP) ..... 2011-135193

(51) Int. Cl.
*H01R 4/24* (2006.01)
*H01R 9/03* (2006.01)
*H01R 13/6592* (2011.01)

(52) U.S. Cl.
CPC ..... *H01R 9/032* (2013.01); *H01R 13/6592* (2013.01); *H01R 4/2429* (2013.01)
USPC ..... 439/417

(58) Field of Classification Search
USPC ..... 439/417, 607.5, 607.51, 395, 404, 405, 439/607.48
See application file for complete search history.

(56) References Cited

U.S. PATENT DOCUMENTS

2006/0030212 A1 2/2006 Harubayashi
2006/0110982 A1 5/2006 Shinmyo
2009/0017684 A1* 1/2009 Lin ..... 439/610

FOREIGN PATENT DOCUMENTS

JP H06-068339 U 9/1994
JP 2006-147359 A 6/2006

OTHER PUBLICATIONS

Chinese office action issued on Mar. 28, 2014 in the counterpart Chinese patent application.

* cited by examiner

*Primary Examiner* — Phuong Dinh
(74) *Attorney, Agent, or Firm* — Marvin A. Motsenbocker; Mots Law, PLLC

(57) ABSTRACT

A shield connector comprises: a shield terminal including a shield shell unit and a shield crimping portion, the shield crimping portion being configured to be crimped on a shield sheath wire of a shielded cable; a cable holder attached to the shield shell unit, the cable holder being configured to hold a core wire of the shielded cable; and a connector housing with a pressure-contact terminal fixed thereto, and being attached to the shield shell unit to which the cable holder is attached, the pressure-contact terminal coming into pressure contact with the core wire by movement of the pressure-contact terminal when attaching the connector housing to the shield shell unit.

13 Claims, 8 Drawing Sheets

SHIELD CONNECTOR

BACKGROUND OF THE INVENTION

1. Field of the Invention

The present invention relates to a shield connector to be connected to a terminal of a shielded cable.

2. Description of the Related Art

As a conventional shield connector, a shield connector 100 is disclosed in Japanese Patent Application Laid-Open Publication No. 2006-147359. As shown in FIG. 9 and FIG. 10, the shield connector 100 includes a connector housing 101 provided with a connector fitting chamber 101*a*, connection terminals 102 housed in the connector housing 101, and a shield shell terminal 110 located on an outer surface of the connector housing 101.

An opponent connector 130 is fitted in the connector fitting chamber 101*a*. Conductors 121*a* of core wires 121 of a shielded cable 120 are connected to the connection terminals 102 by soldering, for example. The shield shell terminal 110 includes a shield shell unit 111 which covers the outer surface of the connector housing 101, and a shield crimping portion 112 provided integrally to the shield shell unit 111. The shield shell unit 111 is fixed to the connector housing 101 by crimping. The shield crimping portion 112 is crimped onto a shield sheath wire 122 of the shielded cable 120.

Next, assembly procedures of the shield connector 100 will be described. First, the conductors 121*a* of the core wires 121 of the shielded cable 120 are connected to the connection terminals 102 by soldering, for example. Then, the connection terminals 102 are disposed in the connector housing 101. Next, the connector housing 101 is attached to the shield shell unit 111 of the shield shell terminal 110. Lastly, the shield crimping portion 112 is crimped onto the shield sheath wire 122 of the shielded cable 120. Thus, the assembly is completed.

SUMMARY OF THE INVENTION

However, in the above-described shield connector 100, a tensile force and a compressive force generated by crimping act on a position of connection between the connection terminals 102 and the core wires 121 when the shield crimping portion 112 is crimped onto the shield sheath wire 122 of the shielded cable 120. As a consequence, the position of connection between the connection terminals 102 and the core wires 121 is susceptible to damages (such as a connection defect).

An object of the present invention is to provide a shield connector in which a position of connection between a terminal and a core wire can be prevented from being damaged by a crimping work of a shield crimping portion.

An aspect of the present invention is a shield connector comprising: a shield terminal including a shield shell unit and a shield crimping portion, the shield crimping portion being configured to be crimped on a shield sheath wire of a shielded cable; a cable holder attached to the shield shell unit, the cable holder being configured to hold a core wire of the shielded cable; and a connector housing with a pressure-contact terminal fixed thereto, and being attached to the shield shell unit to which the cable holder is attached, the pressure-contact terminal coming into pressure contact with the core wire by movement of the pressure-contact terminal when attaching the connector housing to the shield shell unit.

The cable holder may comprise a core wire housing groove configured to house the core wire, and the cable holder may be attached in such a manner that an opening of the core wire housing groove is directed so as to be occluded by the shield shell unit.

The cable holder may comprise a terminal insertion hole to which the pressure-contact terminal of the connector housing is inserted.

One of the shield shell unit and the connector housing may comprise a slide rail unit, and the other one of the shield shell unit and the connector housing may comprise a slide groove to which the slide rail unit is inserted.

According to the present invention, the shield connector can be assembled in the order of performing the crimping work of the shield crimping portion and then performing the pressure-contact work of the pressure-contact terminal. Hence the pressure-contact work of the pressure-contact terminal is performed later than the crimping work of the shield crimping portion. Thus, the position of connection between the terminal and the core wire is not damaged by the crimping work of the shield crimping portion.

DESCRIPTION OF THE PREFERRED EMBODIMENTS

An embodiment of the present invention will be described below with reference to the accompanying drawings.

Figure 1:
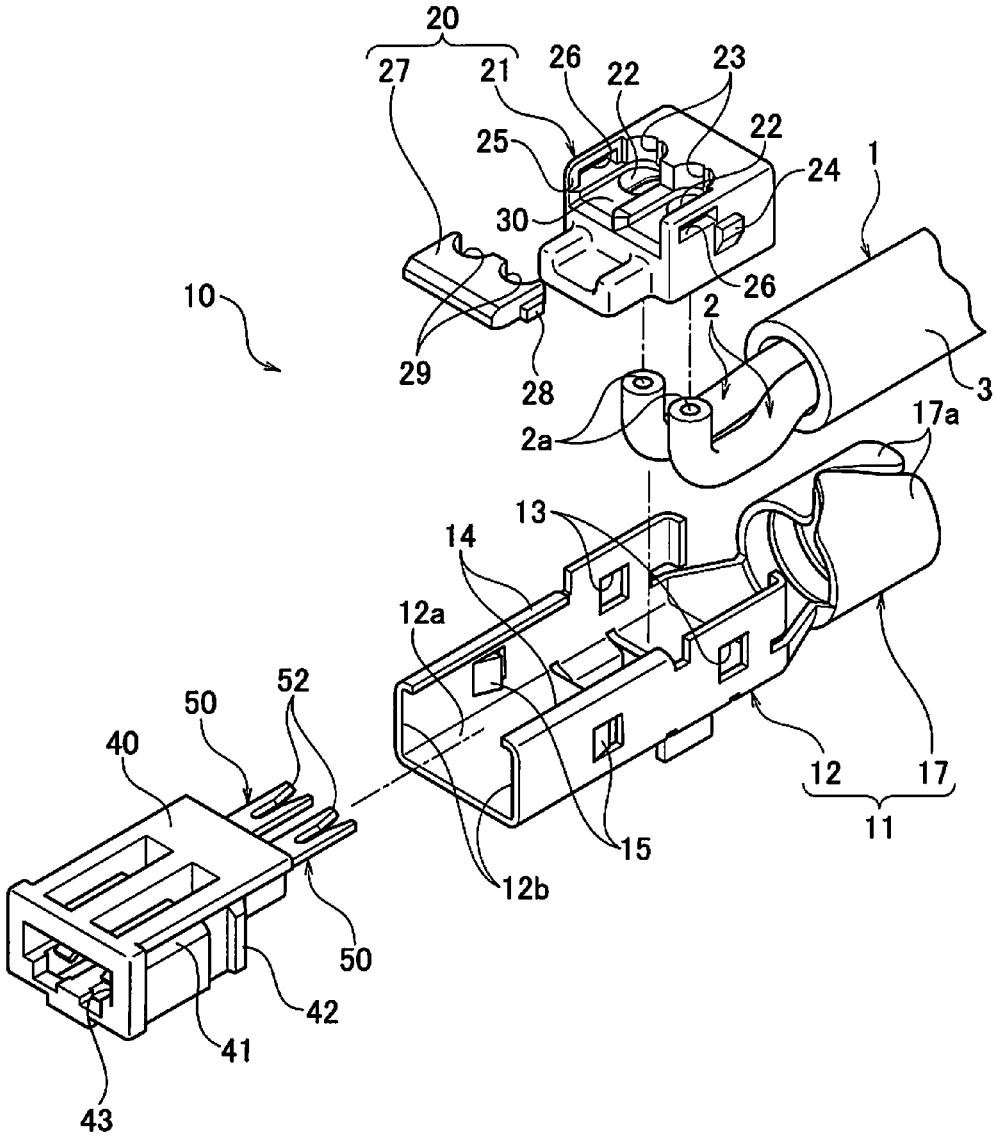
FIG. 1 is an exploded perspective view of a shield connector according to an embodiment of the present invention.
Figure 2:
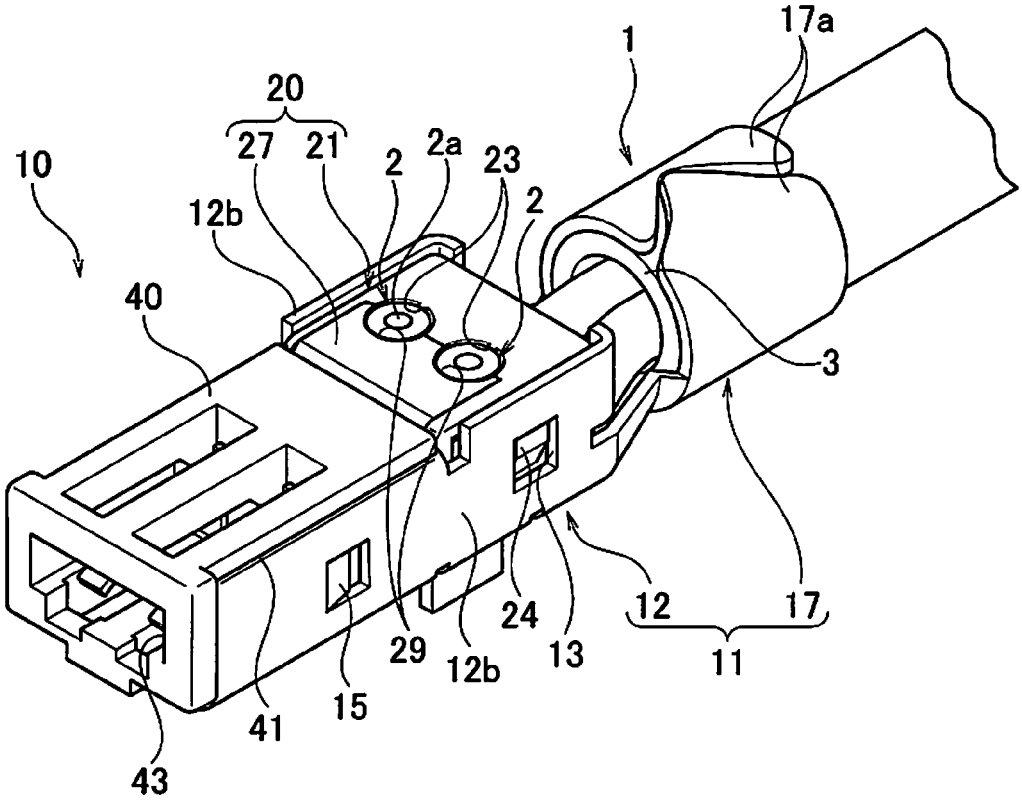
FIG. 2 is a perspective view of the shield connector according to the embodiment of the present invention.
Figure 3:
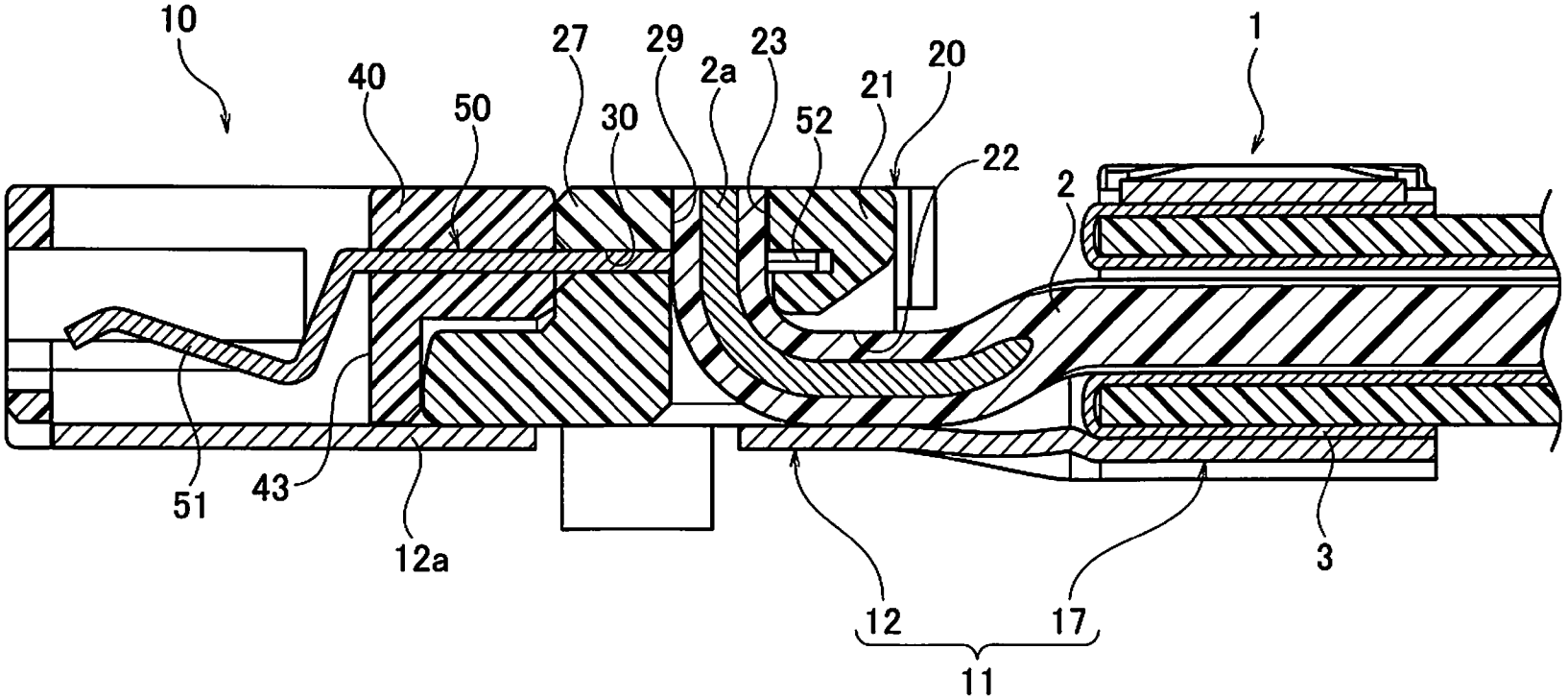
FIG. 3 is a cross-sectional view of the shield connector according to the embodiment of the present invention.

FIG. 1 to FIG. 8 show an embodiment of the present invention. As shown in FIG. 1 to FIG. 3, a shield connector 10 is connected to a terminal of a shielded cable 1.

The shielded cable 1 includes two core wires 2 and a shield sheath wire 3 that covers outer peripheries of the two core wires 2. The two core wires 2 are twisted together to form a twisted pair cable. Each of the core wires 2 is formed of a conductor 2*a* covered with an insulating sheath. The shield sheath wire 3 is formed of a mesh conductor, for example. The shield sheath wire 3 is peeled off and the two core wires 2 are exposed at a terminal side of the shielded cable 1.

The shield connector 10 includes a shield terminal 11, a cable holder 20 attached to the shield terminal 11, and a connector housing 40 similarly attached to the shield terminal 11.

The shield terminal 11 is made of a conductive material. The shield terminal 11 includes a shield shell unit 12 and a shield crimping portion 17 integrally extending from a rear end side of the shield shell unit 12. The shield shell unit 12 is formed of a bottom wall 12*a* and a pair of side walls 12*b*. An upper face and a front face of the shield shell unit 12 are open. A pair of lock holes 13 are formed in the pair of side walls 12*b*, respectively. The pair of side walls 12*b* are provided with a pair of slide rail units 14 and a pair of lock arm stoppers 15.

The shield crimping portion 17 includes a pair of semicircular crimp units 17*a*. In the shield crimping portion 17, the pair of crimp units 17*a* are crimped in such a manner as to reduce a diameter formed therewith. The shield crimping portion 17 is crimped onto an outer peripheral surface of the shield sheath wire 3 by means of plastic deformation attributed to this crimping operation.

The cable holder 20 is attached to the shield shell unit 12 by being inserted thereinto from above. In this way, three sides of the cable holder 20 are substantially covered with the shield shell unit 12.

The cable holder 20 includes a holder body 21 and a cable locking piece 27 slidably locked to the holder body 21.

The holder body 21 is made of an insulating material. The holder body 21 is provided with a pair of core wire housing grooves 22 that are open on a bottom surface of the holder body 21. Further, the holder body 21 is provided with a pair of core wire nipping grooves 23 communicating with the core wire housing grooves 22. The pair of core wires 2 are housed in the pair of core wire housing grooves 22, respectively. Tip ends of the pair of core wires 2 housed in the respective core wire housing grooves 22 are located in the pair of core wire nipping grooves 23. A pair of lock stoppers 24 are provided on both sides of the holder body 21. The pair of lock stoppers 24 are locked in a pair of lock holes 13 in the shield shell unit 12.

The holder body 21 is provided with a slide recess unit 25 to which a cable locking piece 27 is slidably inserted. The holder body 21 is provided with a pair of lock holes 26 which are open to both side faces of this slide recess unit 25.

The cable locking piece 27 is made of an insulating material as similar to the holder body 21. A pair of lock stoppers 28 are provided on both side faces of the cable locking piece 27. A pair of core wire nipping grooves 29 are provided on an insertion forefront of the cable locking piece 27. The cable locking piece 27 is slid into the slide recess unit 25 and the pair of lock stoppers 28 are locked and mounted in the pair of lock holes 26. The tip ends of the pair of core wires 2 are nipped between and fixed to the core wire nipping grooves 23 and 29 which are provided on both the holder body 21 and the cable locking piece 27.

A pair of terminal insertion holes 30 are defined in the cable holder 20 by the holder body 21 and a bottom surface of the cable locking piece 27 locked by the holder body 21. The back of the pair of terminal insertion holes 30 are open toward the respective core wire housing grooves 22. Thus, the respective core wires 2 are disposed in the back of the respective terminal insertion holes 30. A width of each terminal insertion hole 30 is set to a slightly greater width than that of a pressure-contact blade unit 52 of a pressure-contact terminal 50 to be described later.

A pair of slide grooves 41 and a pair of lock walls 42 are respectively provided on both side walls of the connector housing 40. In the connector housing 40, the pair of slide rail units 14 of the shield shell unit 12 are aligned with and slid into the pair of slide grooves 41 while the pair of lock arm stoppers 15 of the shield shell unit 12 are locked by and attached to the pair of lock walls 42. In this way, three sides of the connector housing 40 are substantially covered with the shield shell unit 12. The connector housing 40 is made of an insulating material. The connector housing 40 includes a connector fitting chamber 43 which is open on a front side of the connector housing 40. An opponent connector (not shown) is fitted in this connector fitting chamber 43.

A pair of pressure-contact terminals 50 are fixed to the connector housing 40. The pair of pressure-contact terminals 50 are fixed to the connector housing 40 by means of insert molding or pressing fitting, for example. Each pressure-contact terminal 50 includes a terminal connector 51 to be located in the connector fitting chamber 43 and a pressure-contact blade unit 52 which projects from a rear surface of the connector housing 40. The pressure-contact blade unit 52 is inserted to the terminal insertion hole 30 in the cable holder 20 and is pressure-contacted with the core wire 2. To be more precise, the pressure-contact blade unit 52 penetrates the sheath of the core wire 2, thereby being pressure-contacted with the conductor 2*a* located inside.

Figure 4:
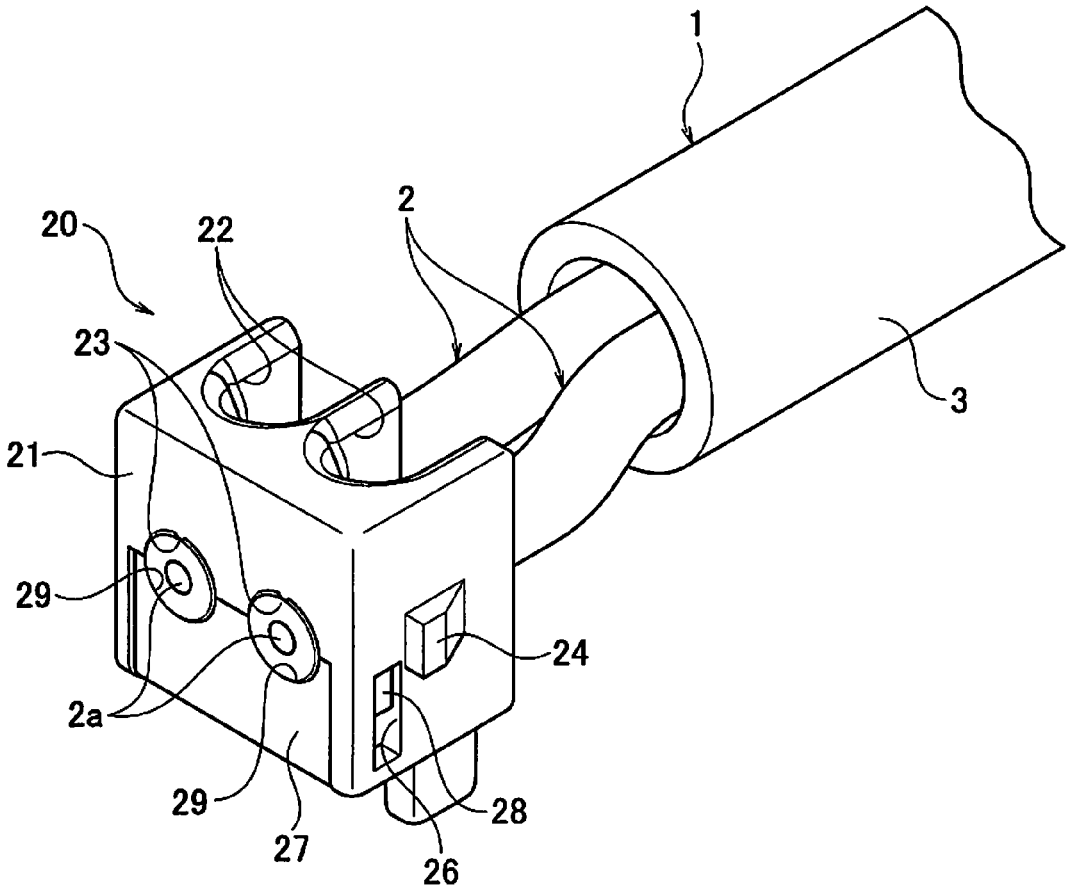
FIG. 4 is a perspective view of a core wire holding process for the shield connector according to the embodiment of the present invention.

Next, assembly procedures of the shield connector 10 will be described. First, as shown in FIG. 4, the tip ends of the pair of core wires 2 are inserted from the bottom surface of the holder body 21 into the pair of core nipping grooves 23. Then, the cable locking piece 27 is slid into the slide recess unit 25 of the holder body 21 and the lock stoppers 28 of the cable locking piece 27 are locked in the lock holes 26 in the holder body 21. Hence the tip ends of the pair of core wires 2 are nipped between the core wire nipping grooves 23 and 29 provided on both the holder body 21 and the cable locking piece 27. Thus, the tip ends of the pair of core wires 2 are held by the cable holder 20 (a core wire holding process).

Figure 5:
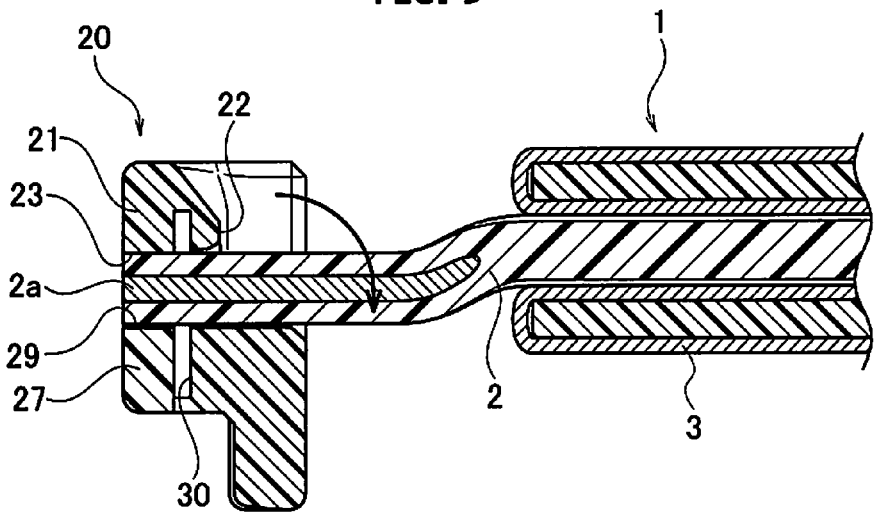
FIG. 5 is a cross-sectional view of the core wire holding process for the shield connector according to the embodiment of the present invention.
Figure 6:
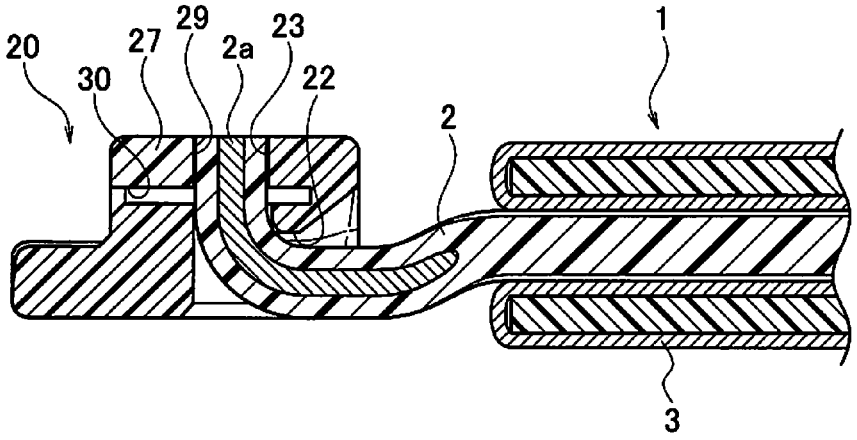
FIG. 6 is a cross-sectional view of the core wire holding process for the shield connector according to the embodiment of the present invention.
Figure 7:
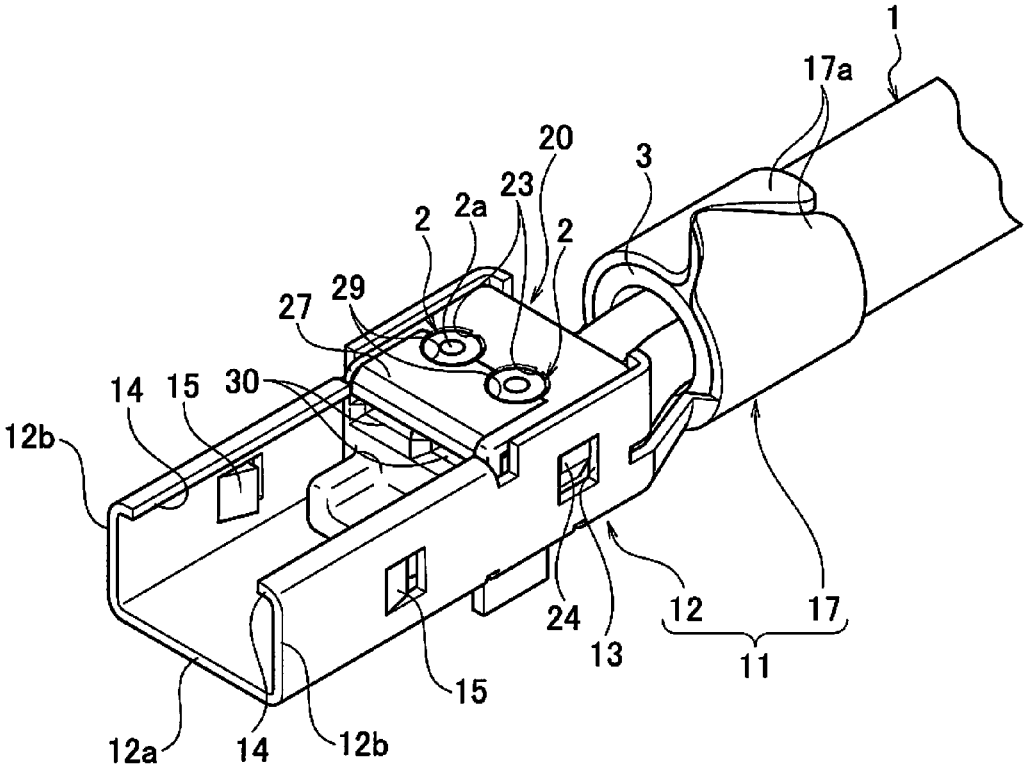
FIG. 7 is a perspective view of the shield connector according to the embodiment of the present invention after undergoing a holder attachment process and a shield crimping process.

Next, the cable holder 20 is turned 90° relative to the pair of core wires 2 as indicated with an arrow in FIG. 5, and the pair of core wires 2 are set in the pair of core wire housing grooves 22 (see FIG. 6). Then, openings of the pair of core wire housing grooves 22 are defined as insertion forefronts and the cable holder 20 is inserted from above into the shield shell unit 12 of the shield terminal 11. When the bottom surface of the holder body 21 is inserted to the position to come into contact with the bottom wall 12*a* of the shield shell unit 12, the pair of lock stoppers 24 of the holder body 21 are locked in the pair of lock holes 13 in the shield shell unit 12. The openings of the pair of core wire housing grooves 22 are occluded by the bottom wall 12*a* of the shield shell unit 12. Accordingly, the cable holder 20 is attached to the shield shell unit 12 of the shield terminal 11 as shown in FIG. 7 (a holder attachment process).

Next, the shield sheath wire 3 of the shielded cable 1 is set in the shield crimping portion 17 of the shield terminal 11 and the pair of crimp units 17*a* of the shield crimping portion 17 are crimped. Thus, the shield crimping portion 17 is crimped onto the shield sheath wire 3 as shown in FIG. 7 (a shield crimping process).

Figure 8:
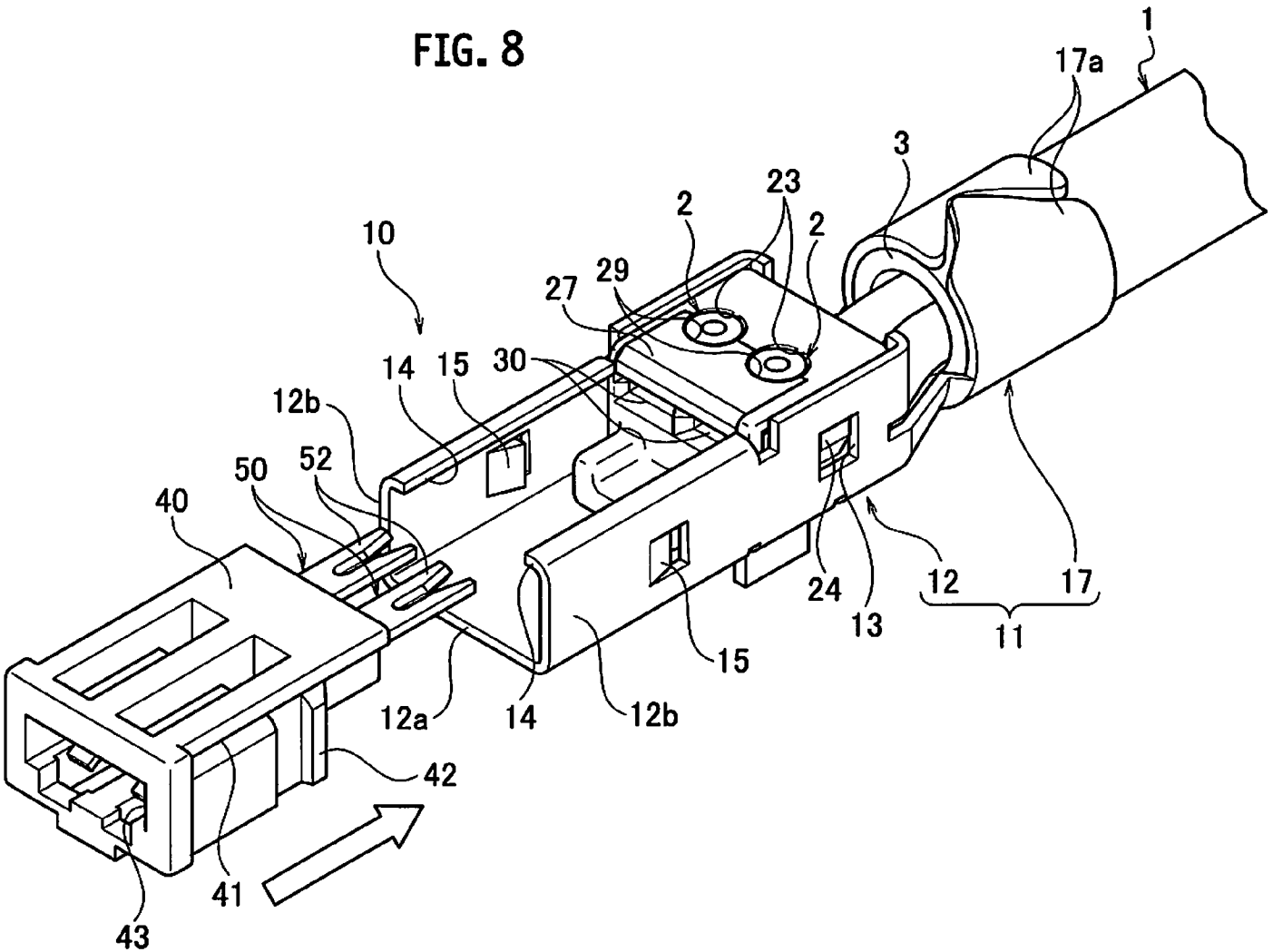
FIG. 8 is a perspective view of a terminal pressure-contact process for the shield connector according to the embodiment of the present invention.
Figure 9:
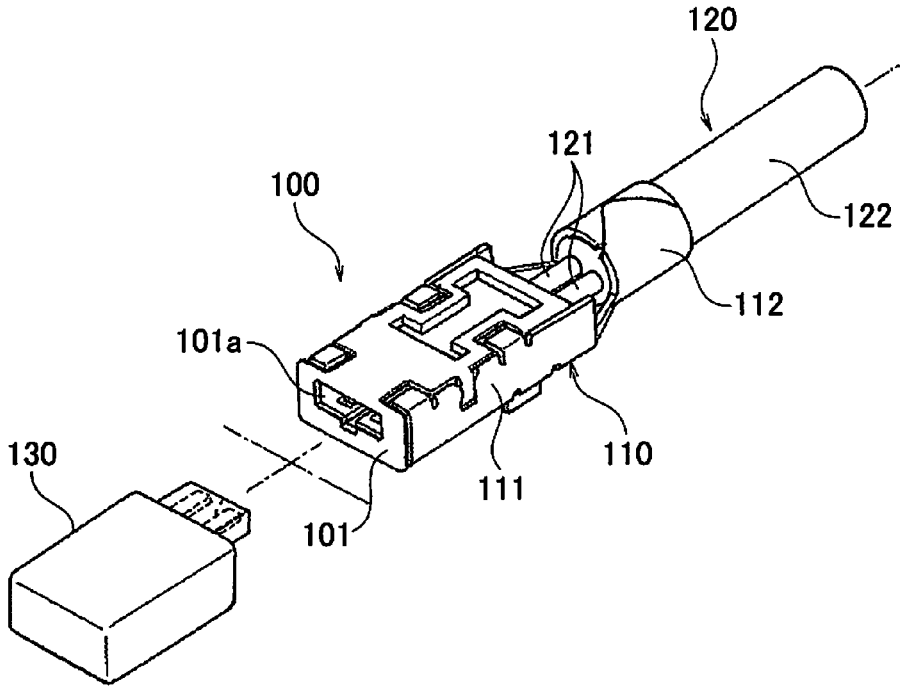
FIG. 9 is a perspective view of a shield connector and an opponent connector in a conventional example.
Figure 10:
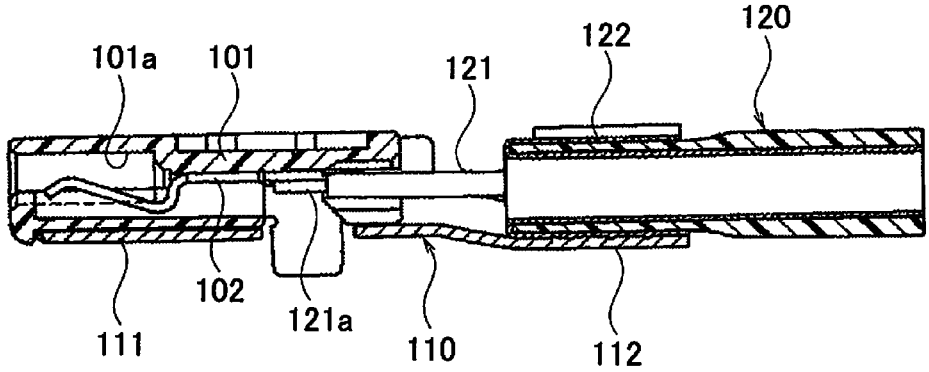
FIG. 10 is a cross-sectional view of the shield connector in the conventional example.

Next, the pair of pressure-contact terminals 50 are defined as insertion forefronts and the connector housing 40 is inserted into the shield shell unit 12 from the front as shown in FIG. 8. Upon this insertion, the pair of slide grooves 41 of the connector housing 40 are slid into the pair of slide rail units 14 of the shield shell unit 12. In a position where the sliding is completed, the lock arm stoppers 15 of the shield shell unit 12 are locked by the lock walls 42 of the connector housing 40. Accordingly, the connector housing 40 is attached to the shield shell unit 12. Meanwhile, in a slide insertion process of the connector housing 40, the respective pressure-contact blade units 52 of the pair of pressure-contact terminals 50 are inserted to the terminal insertion holes 30 in the cable holder 20 and the respective pressure-contact blade units 52 thus inserted are pressure-contacted with the respective core wires 2 (a housing attachment and terminal pressure-contact process).

As described above, the shield connector 10 includes the shield terminal 11, the cable holder 20, and the connector housing 40. The shield terminal 11 is provided with the shield shell unit 12 and the shield crimping portion 17 in which the shield crimping portion 17 is crimped onto the shield sheath wire 3 of the shielded cable 1. The cable holder 20 is configured to hold the core wires 2 of the shielded cable 1 and attached to the shield shell unit 12. The connector housing 40 is configured to fix the pressure-contact terminals 50 thereto, and it is attached to the shield shell unit 12 to which the cable holder 20 is attached, while the pressure-contact terminals 50 are pressure-contacted with the core wires 2 by means of movement of the pressure-contact terminals 50 at the time of attachment. Accordingly, the assembly can be carried out in the order of performing the crimping work of the shield crimping portion 17 and then performing the pressure-contact work of the pressure-contact terminals 50 as in the assembly procedures described above. Hence the pressure-contact work of the pressure-contact terminals 50 is performed later than the crimping work of the shield crimping portion 17. Thus, a position of connection between the pressure-contact terminal 50 and the core wire 2 is not damaged at all (such as a connection defect) by the crimping work of the shield crimping portion 17.

In addition, the respective works to connect the core wires 2 and the shield sheath wires 3 of the shielded cable 1 involve the pressure-contact work and the crimping work. Accordingly, it is easier to perform the connection works as compared to the conventional procedures involving the soldering work and the crimping work.

The cable holder 20 includes the core wire housing grooves 22 to house the core wires 2. The cable holder 20 is attached in such a manner that the openings of the core wire housing grooves 22 are directed so as to be occluded by the shield shell unit 12. Accordingly, it is possible to prevent the core wires 2 from falling out of the core wire housing grooves 22 while retaining workability to house the core wires 2 in the core wire housing grooves 22, and to reliably bring the pressure-contact terminals 50 into pressure contact with the core wires 2.

The cable holder 20 includes the terminal insertion holes 30 to which the pressure-contact terminals 50 of the connector housing 40 are inserted. Accordingly, insertion of the pressure-contact terminals 50 is guided by the terminal insertion holes 30 so that the pressure-contact terminals 50 can be reliably pressure-contacted with the core wires 2.

Meanwhile, the width of each terminal insertion hole 30 is set slightly greater than the width dimension of the pressure-contact blade unit 52 of the pressure-contact terminal 50. Accordingly, the terminal insertion hole 30 can suppress expansion of the pressure-contact blade unit 52 due to a reaction force at the time of pressure contact. Thus, the pressure-contact terminals 50 can be reliably brought into pressure contact with the core wires 2.

The position where the pressure-contact terminal 50 comes into pressure contact with the core wire 2 is defined as a holding position by the cable holder 20, i.e., a position between a location for positioning and another location for positioning by means of bending. Accordingly, the pressure-contact terminals 50 can be reliably brought into pressure contact with the core wires 2.

The shield shell unit 12 is provided with the slide rail units 14, and the connector housing 40 is provided with the slide grooves 41. Thus, the connector housing 40 can be easily and simply attached to the shield shell unit 12. Alternatively, the shield shell unit 12 may be provided with the slide grooves 41, and the connector housing 40 may be provided with the slide rail units 14.

What is claimed is:

1. A shield connector comprising:

a shield terminal including a shield shell unit and a shield crimping portion, the shield crimping portion being configured to be crimped on a shield sheath wire of a shielded cable;

a cable holder attached to the shield shell unit, the cable holder being configured to hold a core wire of the shielded cable; and a connector housing with a pressure-contact terminal fixed thereto, and being attached to the shield shell unit to which the cable holder is attached, the pressure-contact terminal coming into pressure contact with the core wire by movement of the pressure-contact terminal when attaching the connector housing to the shield shell unit, wherein the connector housing is configured to slide into the shield terminal after attachment of the core wire to the cable holder.

2. The shield connector according to claim 1, wherein the cable holder comprises a core wire housing groove configured to house the core wire, and the cable holder is attached in such a manner that an opening of the core wire housing groove is directed so as to be occluded by the shield shell unit.

3. The shield connector according to claim 1, wherein the cable holder comprises a terminal insertion hole to which the pressure-contact terminal of the connector housing is inserted.

4. The shield connector according to claim 2, wherein the cable holder comprises a terminal insertion hole to which the pressure-contact terminal of the connector housing is inserted.

5. The shield connector according to claim 1, wherein one of the shield shell unit and the connector housing comprises a slide rail unit, and the other one of the shield shell unit and the connector housing comprises a slide groove to which the slide rail unit is inserted.

6. The shield connector according to claim 2, wherein one of the shield shell unit and the connector housing comprises a slide rail unit, and the other one of the shield shell unit and the connector housing comprises a slide groove to which the slide rail unit is inserted.

7. The shield connector according to claim 3, wherein one of the shield shell unit and the connector housing comprises a slide rail unit, and the other one of the shield shell unit and the connector housing comprises a slide groove to which the slide rail unit is inserted.

8. The shield connector according to claim 4, wherein one of the shield shell unit and the connector housing comprises a slide rail unit, and the other one of the shield shell unit and the connector housing comprises a slide groove to which the slide rail unit is inserted.

9. The shield connector according to claim 1, wherein the connector housing is configured to slide into the shield terminal along a long axis of the shielded cable.

10. The shield connector according to claim 1, wherein the connector housing is configured to slide into the shield terminal after crimping of the shield crimping portion and thereby avoid subsequent movement between the pressure-contact terminal and the core wire.

11. The shield connector according to claim 10, wherein the connector housing is configured to slide into the shield terminal along a long axis of the shielded cable.

12. The shield connector according to claim 1, wherein three sides of the connector housing are substantially covered with the shield shell unit.

13. The shield connector according to claim 10, wherein three sides of the connector housing are substantially covered with the shield shell unit.

* * * * *